US010132013B2

(12) United States Patent
Shen et al.

(10) Patent No.: US 10,132,013 B2
(45) Date of Patent: Nov. 20, 2018

(54) CONDUCTIVE TEXTILE

(71) Applicant: TAIWAN TEXTILE RESEARCH INSTITUTE, New Taipei (TW)

(72) Inventors: Chien-Lung Shen, New Taipei (TW); Kun-Chuan Tsai, New Taipei (TW); Chien-Fa Tang, New Taipei (TW); Fen-Ling Chen, New Taipei (TW)

(73) Assignee: TAIWAN TEXTILE RESEARCH INSTITUTE, New Taipei (TW)

( * ) Notice: Subject to any disclaimer, the term of this patent is extended or adjusted under 35 U.S.C. 154(b) by 462 days.

(21) Appl. No.: 15/147,110

(22) Filed: May 5, 2016

(65) Prior Publication Data

US 2016/0333503 A1 Nov. 17, 2016

(30) Foreign Application Priority Data

May 12, 2015 (TW) ..... 104115061 A

(51) Int. Cl.
*D03D 15/00* (2006.01)

(52) U.S. Cl.
CPC ..... *D03D 15/00* (2013.01); *D10B 2401/16* (2013.01); *D10B 2501/06* (2013.01)

(58) Field of Classification Search
CPC . D03D 15/00; D10B 2401/16; D10B 2501/06
USPC ..... 442/190
See application file for complete search history.

(56) References Cited

U.S. PATENT DOCUMENTS

| | | | |
|---|---|---|---|
| 3,495,025 | A | 2/1970 | Ross et al. |
| 3,654,381 | A | 4/1972 | Copp et al. |
| 4,143,236 | A | 3/1979 | Ross et al. |
| 4,460,803 | A | 7/1984 | Piper |
| 4,463,323 | A | 7/1984 | Piper |
| 4,712,298 | A | 12/1987 | Mondor, III |
| 4,728,080 | A | 3/1988 | Kurschner et al. |
| 4,746,769 | A | 5/1988 | Piper |
| 5,380,954 | A | 1/1995 | Orr, Jr. |
| 5,603,514 | A | 2/1997 | Jencks et al. |
| 5,760,340 | A | 6/1998 | Orr, Jr. et al. |
| 7,754,626 | B2 | 7/2010 | Baron et al. |
| 8,263,215 | B2 | 9/2012 | Burr et al. |

(Continued)

FOREIGN PATENT DOCUMENTS

| | | | |
|---|---|---|---|
| CN | 102031615 | A | 4/2011 |
| CN | 102385947 | A | 3/2012 |

(Continued)

*Primary Examiner* — Cephia D Toomer
(74) *Attorney, Agent, or Firm* — McClure, Qualey & Rodack, LLP

(57) ABSTRACT

A conductive textile is provided, including warp and weft, and the warp and the weft are interwoven. The warp includes a signal-transmitting unit, an electrical connecting unit, and at least a first warp conductive fiber. The signal-transmitting unit consists of a first signal-transmitting cable and a second signal-transmitting cable, which are intertwined. Each of the first signal-transmitting cable and the second signal-transmitting cable includes a central conductive fiber and an outer insulating layer. The electrical connecting unit consists of a first power cable and a second power cable. The first warp conductive fiber is disposed between the signal-transmitting unit and the electrical connecting unit. The weft includes a weft conductive fiber.

15 Claims, 6 Drawing Sheets

(56) References Cited

U.S. PATENT DOCUMENTS

| | | | | |
|---|---|---|---|---|
| 8,367,932 | B2 | 2/2013 | Matsumoto | |
| 8,435,069 | B2 | 5/2013 | Burke et al. | |
| 8,729,399 | B2 | 5/2014 | Huang et al. | |
| 8,738,118 | B2 | 5/2014 | Moon et al. | |
| 2011/0073353 | A1 | 3/2011 | Lee et al. | |
| 2013/0102217 | A1* | 4/2013 | Jeon | D03D 15/0027 442/182 |
| 2014/0170920 | A1 | 6/2014 | Manipatruni et al. | |

FOREIGN PATENT DOCUMENTS

| | | | |
|---|---|---|---|
| CN | 102388515 | A | 3/2012 |
| CN | 102592745 | A | 7/2012 |
| CN | 103168651 | A | 6/2013 |
| EP | 00119717 | A2 | 9/1984 |
| EP | 00119717 | A3 | 1/1985 |
| EP | 00119717 | B1 | 1/1987 |
| TW | 201425672 | A | 7/2014 |
| TW | 201425678 | A | 7/2014 |
| WO | 03094719 | A1 | 11/2003 |

* cited by examiner

CONDUCTIVE TEXTILE

REFERENCE TO RELATED APPLICATION

This application claims priority to Taiwan Application Serial Number 104115061, filed May 12, 2015, which is herein incorporated by reference.

BACKGROUND OF THE INVENTION

Field of the Invention

The present invention relates to a textile, and in particular to a conductive textile.

The Prior Art

In recent years, the multifunctional textile has been developed with rapidly technical progress to facilitate the convenience of human life. For instance, electronic components may be attached to the textile, and the clothes made of the textile, which is attached with the electronic components, may be applied to new fields. However, the present transmission line is usually used a round wire structure. If the present transmission is applied to clothes, it is hard to fix the wire traces, and the users may feel uncomfortable while wearing the clothes because of the stiff touch.

In addition, the present major method of shielding the interfering sources is that coating a conductive film material, such as aluminum foil or metal netting cloth, on the outside of the wires, and then coating an insulating material or another conductive film material on multiple sets of wires. However, the present shielding method is improper to be applied to the clothes while considering the comfort of wearing.

Although a flat wire structure has been appeared recently, it still cannot combine with the textiles or sewed thereon.

Accordingly, It needs a conductive textile, which can solve the above problems and has the advantages of the combination with the textiles, the resistance to noise, etc.

SUMMARY OF THE INVENTION

The present disclosure provides a conductive textile including warp and weft, and the warp and the weft are interwoven. The warp includes a signal-transmitting unit, an electrical connecting unit, and at least a first warp conductive fiber. The signal-transmitting unit consists of a first signal-transmitting cable and a second signal-transmitting cable, which are intertwined. Each of the first signal-transmitting cable and the second signal-transmitting cable includes a central conductive fiber and an outer insulating layer. The electrical connecting unit consists of a first power cable and a second power cable. The first warp conductive fiber is disposed between the signal-transmitting unit and the electrical connecting unit. The weft includes a weft conductive fiber.

In an embodiment of the present disclosure, the amount of the first warp conductive fiber is 2.

In an embodiment of the present disclosure, the materials of the central conductive fiber, the first warp conductive fiber and the weft conductive fiber are individually selected from silver, copper, carbon black, graphite, graphene, stainless steel, polyaniline or Polyethylenedioxythiophene (PEDOT:PSS).

In an embodiment of the present disclosure, the materials of the outer insulating layer are selected from polyvinyl chloride (PVC), Polytetrafluoroethene (PTFE), Polyurethane (PU), polyacrylic acid or polyimide and the derivatives thereof.

In an embodiment of the present disclosure, the warp further includes at least a first warp insulating fiber disposed between the signal-transmitting unit and the electrical connecting unit.

In an embodiment of the present disclosure, at least one of the first warp insulating fibers is arranged between at least two of the first warp conductive fibers.

In an embodiment of the present disclosure, the individual outside of the signal-transmitting unit and the electrical connecting unit has at least a second warp conductive fiber disposed thereon, and at least a second warp insulating fiber is disposed between the second warp conductive fiber and the signal-transmitting unit or the electrical connecting unit.

In an embodiment of the present disclosure, the individual outside of the signal-transmitting unit and the electrical connecting unit has at least a third warp conductive fiber disposed thereon, and the third warp conductive fiber is directly adjacent to the signal-transmitting unit or the electrical connecting unit.

In an embodiment of the present disclosure, the warp further includes at least two third warp insulating fibers disposed on the outermost side of the warp.

In an embodiment of the present disclosure, the warp is an axially symmetric structure.

In an embodiment of the present disclosure, the weft further includes a weft insulating fiber.

In an embodiment of the present disclosure, the weft insulating fiber is between the adjacent weft conductive fibers.

In an embodiment of the present disclosure, the weft insulating fiber and the weft conductive fiber are intertwined.

In an embodiment of the present disclosure, the warp presents an s-type trace.

In an embodiment of the present disclosure, the twisting degrees of the signal-transmitting unit and the electrical connecting unit are equal to or large than 75 TPM.

The conductive textile of the present disclosure is a structure with flat wires, which has high strength and flexibility and can combine with the clothes by sewing.

BRIEF DESCRIPTION OF THE DRAWINGS

The disclosure could be more fully understood by reading the following detailed description of the embodiment, with reference made to the accompanying drawings as follows.

DETAILED DESCRIPTION OF THE PREFERRED EMBODIMENT

Figure 1:
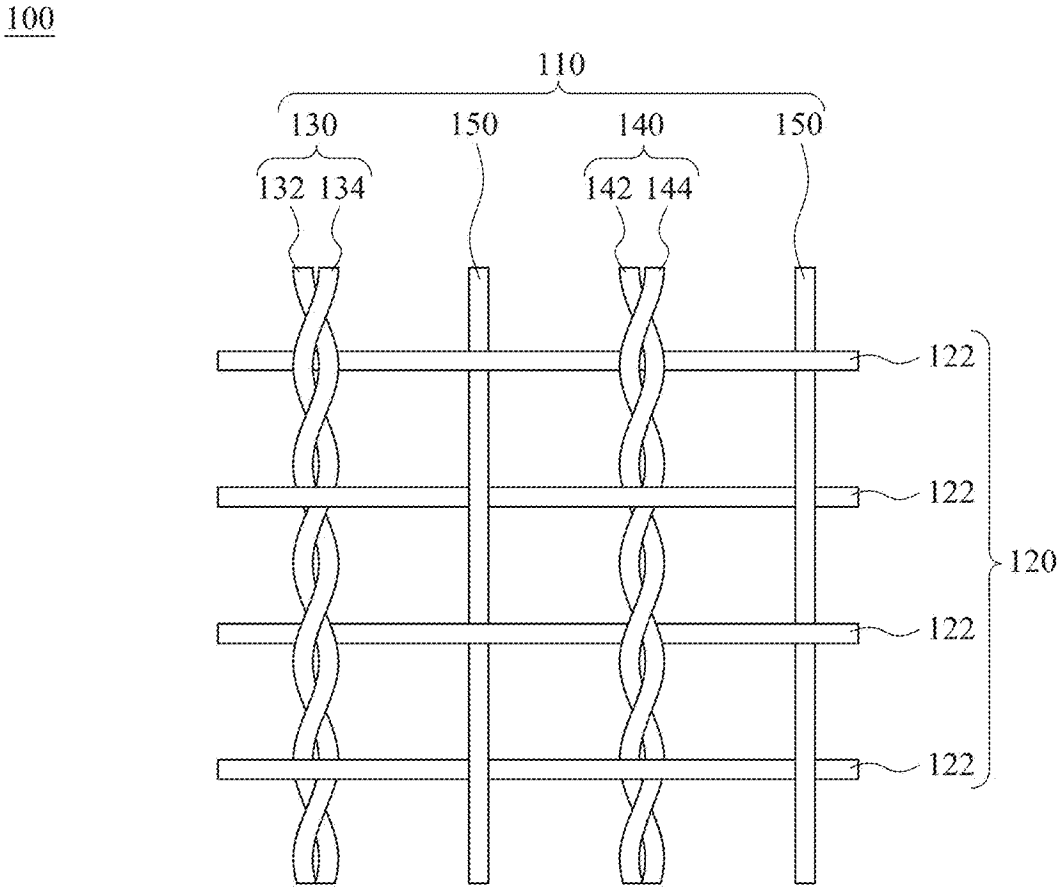
FIG. 1 is a schematic view illustrating the conductive textile according to an embodiment of the present disclosure.

Reference will now be made in detail to the present embodiments of the invention, examples of which are illustrated in the accompanying drawings. Wherever possible, the same reference numbers are used in the drawings and the description to refer to the same or like parts.

The following embodiments are disclosed with accompanying diagrams for detailed description. For illustration clarity, many details of practice are explained in the following descriptions. However, it should be understood that these details of practice do not intend to limit the present invention. That is, these details of practice are not necessary in parts of embodiments of the present invention. Furthermore, for simplifying the drawings, some of the conventional structures and elements are shown with schematic illustrations.

Please refer to FIG. 1. FIG. 1 is a schematic view illustrating the conductive textile 100 according to an embodiment of the present disclosure. The conductive textile 100 includes warp 110 and weft 120, and the warp 110 and the weft 120 are interwoven to form the conductive textile 100. The warp 110 includes a signal-transmitting unit 130, an electrical connecting unit 140, and a first warp conductive fiber 150. The signal-transmitting unit 130 consists of a first signal-transmitting cable 132 and a second signal-transmitting cable 134, which are intertwined. Each of the first signal-transmitting cable 132 and the second signal-transmitting cable 134 includes a central conductive fiber (not shown) and an outer insulating layer (not shown). The electrical connecting unit 140 consists of a first power cable 142 and a second power cable 144. The first power cable 142 and the second power cable 144 are intertwined as shown in FIG. 1, but it is not intended to limit the present invention. One person skilled in the art can decide whether the first power cable 142 and the second power cable 144 are intertwined in accordance with the actual needs of the wire arrangement of the conductive textile. The first warp conductive fiber 150 is disposed between the signal-transmitting unit 130 and the electrical connecting unit 140. The weft 120 includes a weft conductive fiber 122.

In the present embodiment, the intertwined method of the first signal-transmitting cable 132 and the second signal-transmitting cable 134 as well as the first power cable 142 and the second power cable 144 may be s-twist or z-twist independently. For instance, the first signal-transmitting cable 132 and the second signal-transmitting cable 134 as well as the first power cable 142 and the second power cable 144 may be intertwined (or known as "mutual twist") by the doup harness. In addition, the intertwining of the signal-transmitting cables in the signal-transmitting unit 130 can balance the electric charge between the two of signal-transmitting cables.

In an embodiment of the present disclosure, the twisting degrees of the signal-transmitting unit 130 and the electrical connecting unit 140 are equal to or large than 75 TPM (twists per meter). For example, it may be 79 TPM, and the "TPM" is representative of "twists per meter".

When the conductive textile is applied to universal serial bus (USB) 2.0, the signal can be carried by only one of the first signal-transmitting cable 132 and the second signal-transmitting cable 134 because of the transmission mode.

The amount of the first warp conductive fiber 150 may be arbitrary, which can shield the electric field between the signal-transmitting unit 130 and the electrical connecting unit 140. In an embodiment of the present disclosure, the amount of the first warp conductive fiber 150 is 2. In other embodiments, the amount of the first warp conductive fiber 150 may be singular. For instance, when the amount of the first warp conductive fiber 150 is 1 or 3, one of the first warp conductive fiber 150 may be used to the elements on the two ends of the conductive textile to have the same electric potential, so as to prevent that the elements on the two ends of the conductive textile generate arcing because of the potential difference.

In an embodiment of the present disclosure, the materials of the central conductive fiber, the first warp conductive fiber 150 and the weft conductive fiber 122 are individually selected from silver, copper, carbon black, graphite, graphene, stainless steel, polyaniline or Polyethylenedioxythiophene (PEDOT:PSS).

In an embodiment of the present disclosure, the conductive fiber stated above is covered by an outer insulating layer. The materials of the outer insulating layer are selected from polyvinyl chloride (PVC), Polytetrafluoroethene (PTFE), Polyurethane (PU), polyacrylic acid or polyimide and the derivatives thereof. For instance, the outer insulating layer may cover the central conductive fiber by coating or yarn-covering.

The weft 120 including a weft conductive fiber 122 is used for forming a 3D stereoscopic shielding net to shield the stereoscopic electric field.

The present disclosure provides a conductive textile, which has high strength and flexibility and can combine with the clothes by sewing. The warp conductive fiber is interposed between the signal-transmitting unit and the electrical connecting unit in the conductive textile of the present disclosure so as to offset signal attenuation during the transmission and obstruct the interference sources from lateral level. Simultaneously, the weft conductive fiber is woven to form a 3D stereoscopic shielding net, so that the conductive textile of the present disclosure may resist the noise. The organizations of the conductive textile of the present disclosure have many variations, and the touch may be soft or stiff. The conductive textile of the present disclosure, which has high feasibility of mass production, may function as signal transmission and be hidden in general fabric so as to be applied to the wearable application market such as electronic smart clothing, smart home, wearing apparel, electrical transmission ropes or other electrical appliances, etc.

Figure 2:
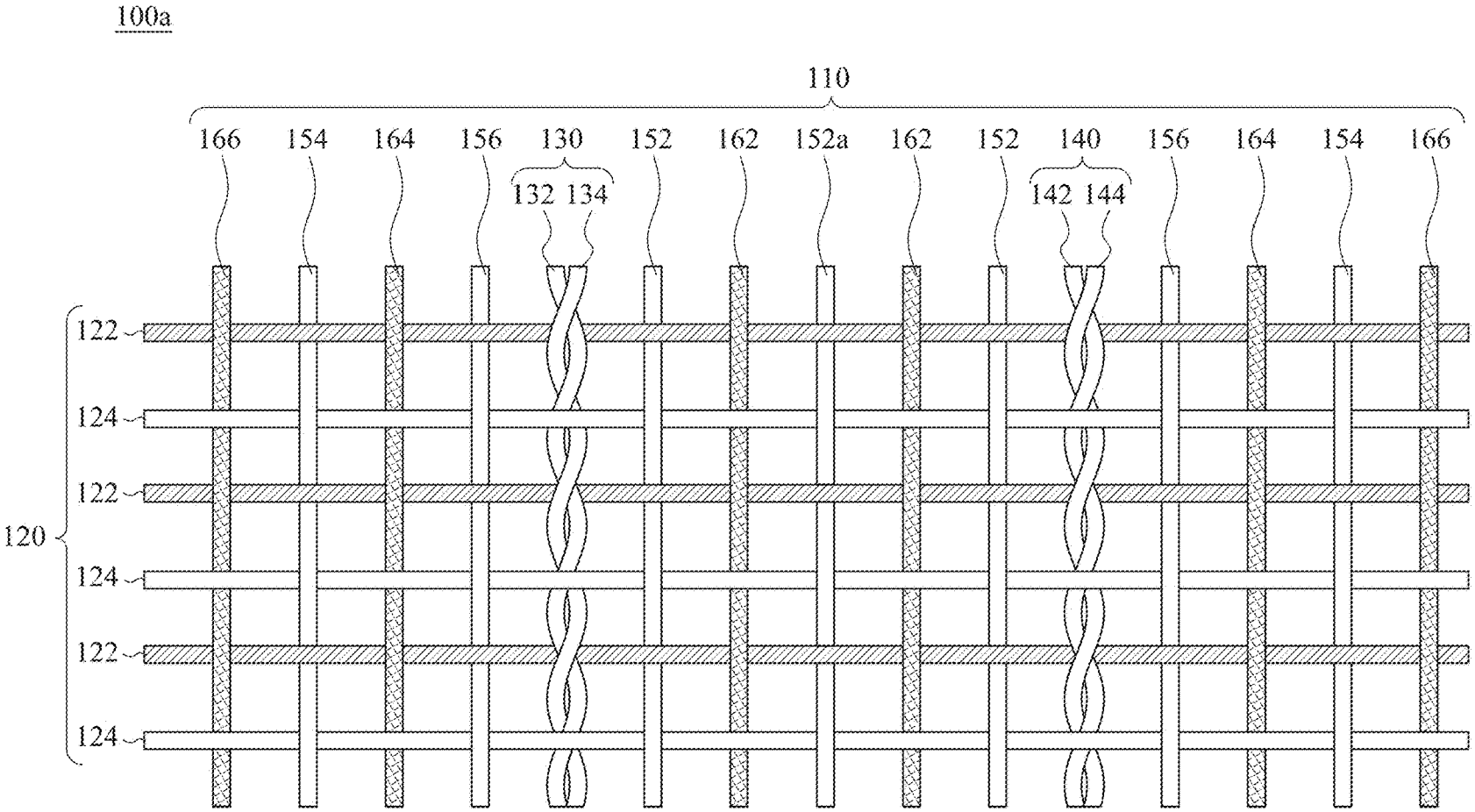
FIG. 2 is a schematic view illustrating the conductive textile according to an embodiment of the present disclosure.

Please refer to FIG. 2. FIG. 2 is a schematic view illustrating the conductive textile 100*a* according to another embodiment of the present disclosure. In the embodiment, the warp 110 of the conductive textile 100*a* further includes at least a first warp insulating fiber 162 disposed between the signal-transmitting unit 130 and the electrical connecting unit 140. Preferably, the first warp insulating fiber 162 is arranged between at least two of the first warp conductive fibers 152. In the embodiment, the amount of the first warp insulating fiber 162 is 2, and the warp 110 may further include a first warp conductive fiber 152*a* between the two first warp insulating fibers 162 (as shown in FIG. 2).

In addition, the individual outside of the signal-transmitting unit 130 and the electrical connecting unit 140 of the conductive textile 100*a* has at least a second warp conductive fiber 154 disposed thereon, and at least a second warp insulating fiber 164 is disposed between the second warp conductive fiber 154 and the signal-transmitting unit 130 as well as the second warp conductive fiber 154 and the electrical connecting unit 140.

Besides, the individual outside of the signal-transmitting unit 130 and the electrical connecting unit 140 of the conductive textile 100*a* has at least a third warp conductive fiber 156 disposed thereon, and the third warp conductive fiber 156 is directly adjacent to the signal-transmitting unit 130 or the electrical connecting unit 140.

It should be noted that the "outside" of the signal-transmitting unit 130 and the electrical connecting unit 140 herein refers to the sides opposite to the sides of the signal-transmitting unit 130 and the electrical connecting unit 140 facing to each other.

The materials of the second warp conductive fiber 154 and the third warp conductive fiber 156 may refer to the materials of the first warp conductive fiber 150 stated above, and hence are not repeat herein.

Furthermore, the warp 110 of the conductive textile 100*a* further includes at least two third warp insulating fibers 166 disposed on the outermost side of the warp 110. In should be noted that the "outermost side" of the warp 110 herein refers to the two external sides of aligned-warp 110. In other words, when the warp 110 and the weft 120 are interwoven to form a conductive textile 100, the third warp insulating fibers 166 is aligned on the warp line of the two external sides of the warp 110. Only one of the two sides of the third warp insulating fibers 166 is adjacent to other warp lines.

In an embodiment of the present disclosure, the warp 110 is an axially symmetric structure. For instance, the first warp conductive fiber 152*a* functions as a symmetric axis, and the arrangements of two opposite areas, which are individually on the two opposite sides of the symmetric axis, are mirror symmetry as shown in FIG. 2.

In the embodiment of the present disclosure shown in FIG. 2, the weft 120 may further includes a weft insulating fiber 124. The weft insulating fiber 124 is between the weft conductive fibers 122 as shown in FIG. 2, but it is not intended to limit the present invention. One person skilled in the art can decide that the weft insulating fiber 124 is between the weft conductive fibers 122 or intertwined with the weft conductive fibers 122 with the actual needs of the wire arrangement of the conductive textile.

The warp insulating fiber 162, 164, 166 and the weft insulating fiber 124 may be independently selected from a group consisting of cotton, silk, linen, nylon and polyester. In an embodiment of the present disclosure, the warp 110 presents an s-type trace. In the embodiment, the materials of the warp 110 may be rubber band yarns or elastomeric yarns, which presents a wave-like arrangement, and the plural wave-like warp are sandwiched in the weft traversing to form woven wires with stretching property. The conductive textile interwoven by the warp 110 and weft 120 has good elasticity and tensile strength.

The differences between the conductive textile 100*a* and the conductive textile 100 do not affect the function of each element in the embodiment. Accordingly, the conductive textile 100*a* and the conductive textile 100 have the same functions and advantages.

The following embodiments are disclosed for detailed description, which are by examples, but not intended to limit the present invention. The scope of protection of the present invention is defined by the claims attached below.

Example 1

Figure 3:
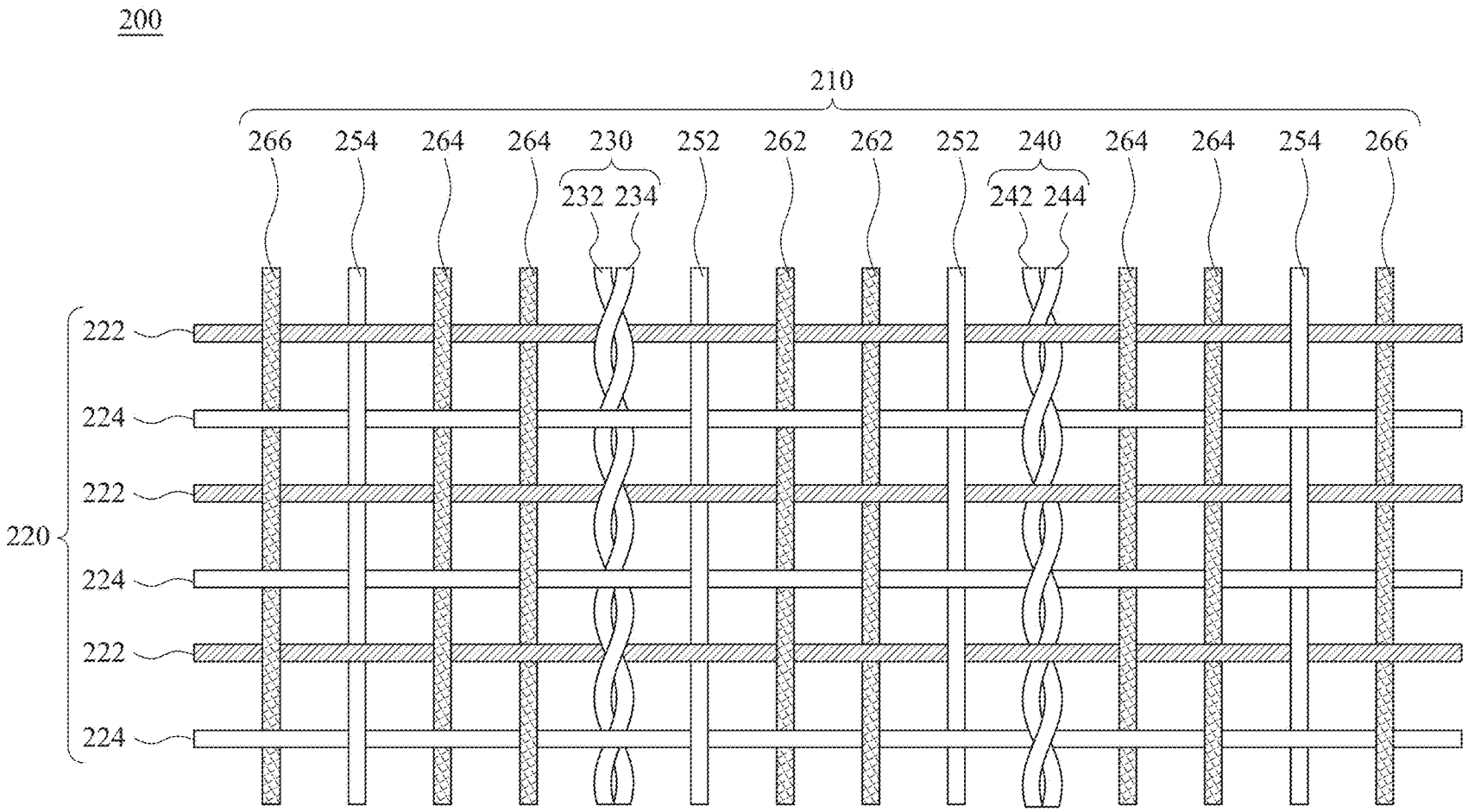
FIG. 3 is a schematic view illustrating the conductive textile according to an embodiment of the present disclosure.

Please refer to FIG. 3. FIG. 3 is a schematic view illustrating the conductive textile 200 according to the example 1 of the present disclosure. The conductive textile 200 includes warp 210 and weft 220, and the warp 210 and the weft 220 are interwoven to form the conductive textile 200.

The warp 210 includes a signal-transmitting unit 230, an electrical connecting unit 240, and a first warp conductive fiber 252, a second warp conductive fiber 254, a first warp insulating fiber 262, a second warp insulating fiber 264 and a third warp insulating fiber 266. The signal-transmitting unit 230 consists of a first signal-transmitting cable 232 and a second signal-transmitting cable 234, which are intertwined. Each of the first signal-transmitting cable 232 and the second signal-transmitting cable 234 includes a central conductive fiber (not shown) and an outer insulating layer (not shown). The electrical connecting unit 240 consists of a first power cable 242 and a second power cable 244, which are intertwined. Each of the first power cable 242 and the second power cable 244 includes a central conductive fiber (not shown) and an outer insulating layer (not shown). The first warp conductive fiber 252 is disposed between the signal-transmitting unit 230 and the electrical connecting unit 240. The second warp conductive fiber 254 is disposed on the individual outside of the signal-transmitting unit 230 and the electrical connecting unit 240. The "outside" refers to the sides opposite to the sides of the signal-transmitting unit 230 and the electrical connecting unit 240 facing to each other. The first warp insulating fiber 262 is disposed between the first warp conductive fibers 252. The second warp insulating fiber 264 is disposed between the second warp conductive fiber 254 and the signal-transmitting unit 230 or the electrical connecting unit 240. The third warp insulating fiber 266 is disposed on the outermost side of the warp 210. The "outermost" side refers to the two external sides of aligned-warp 210.

A weft 220 includes a weft conductive fiber 222 and a weft insulating fiber 224. The weft conductive fiber 222 and the weft insulating fiber 224 are disposed alternately.

Test the result of signal transmission of the conductive textile 200 in the example 1, and the conductive textile 200 is made of various materials of which the arrangement illustrated in FIG. 3. In an example 1-1, the material of the conductive fiber of the conductive textile is silver. In an example 1-2, the material of the conductive fiber of the conductive textile is carbon black. The conductive textile, which does not include the conductive fiber and of which the signal-transmitting cable and the power cable are not intertwined, is used as a comparative example. The results of the test above please refer to FIGS. 6A~6C.

Figure 6A:
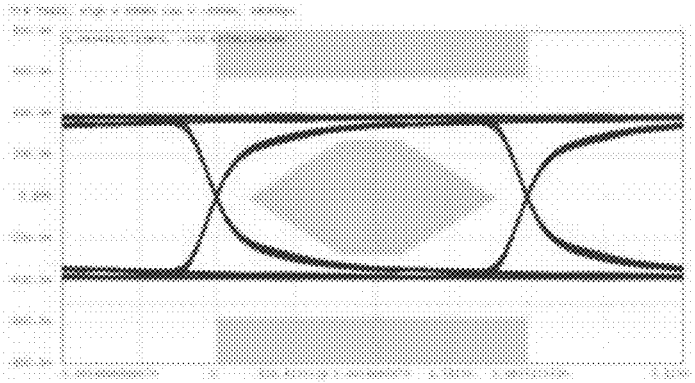
FIG. 6A~6C are schematic views showing the test results of the experimental example and the comparative example of the conductive textile of the present disclosure.
Figure 6B:
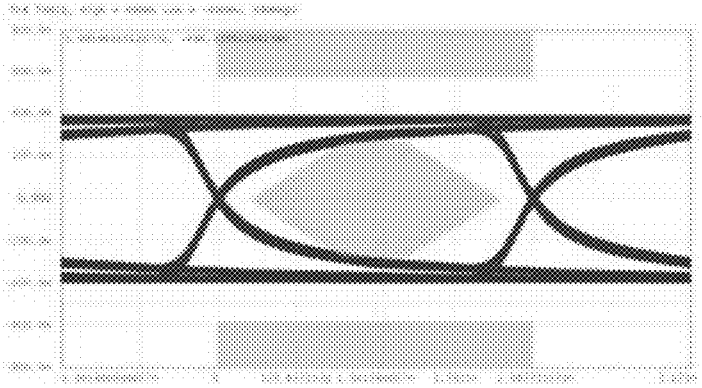
Figure 6C:
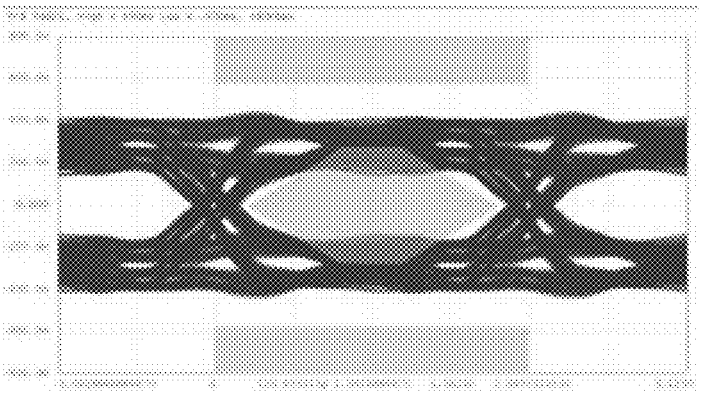

FIGS. 6A~6C show the test results of the example 1-1, example 1-2 and the comparative example of the conductive textile of the present disclosure. The images of FIGS. 6A~6C are the test results by using the textile wire USB 2.0 eye pattern in Electronics Testing Center, Taiwan. FIGS. 6A~6C are respectively representative of the test result of the example 1-1, the example 1-2 and the comparative example. The test result of eye pattern which is not in contact with the diamond in the middle means that the signal transmission is good, and hence the cycle pattern is as wide as possible. In addition, table 1 shows the test result of textile wire signal by using the inspection equipment in Electronics Testing Center, Taiwan so as to measure the anti-noise effect of textile wire at different frequencies.

TABLE 1

| | Samples | | |
|---|---|---|---|
| Frequencies (MHz) | Example 1-1 | Example 1-2 | Comparative example |
| 200 | −1.4820 dB | −2.5583 dB | −5.2812 dB |
| 400 | −2.1971 dB | −4.1314 dB | −2.0810 dB |

According to the test result of FIGS. 6A~6C and Table 1, when the signal-transmitting cable and the power cable are intertwined, the signal transmission of the examples of the present disclosure is better than the comparative example. In other words, when the conductive fiber is made of silver or carbon black and the signal cables are intertwined, the textile wire has better anti-noise effect in the USB 2.0 field.

Example 2

Figure 4:
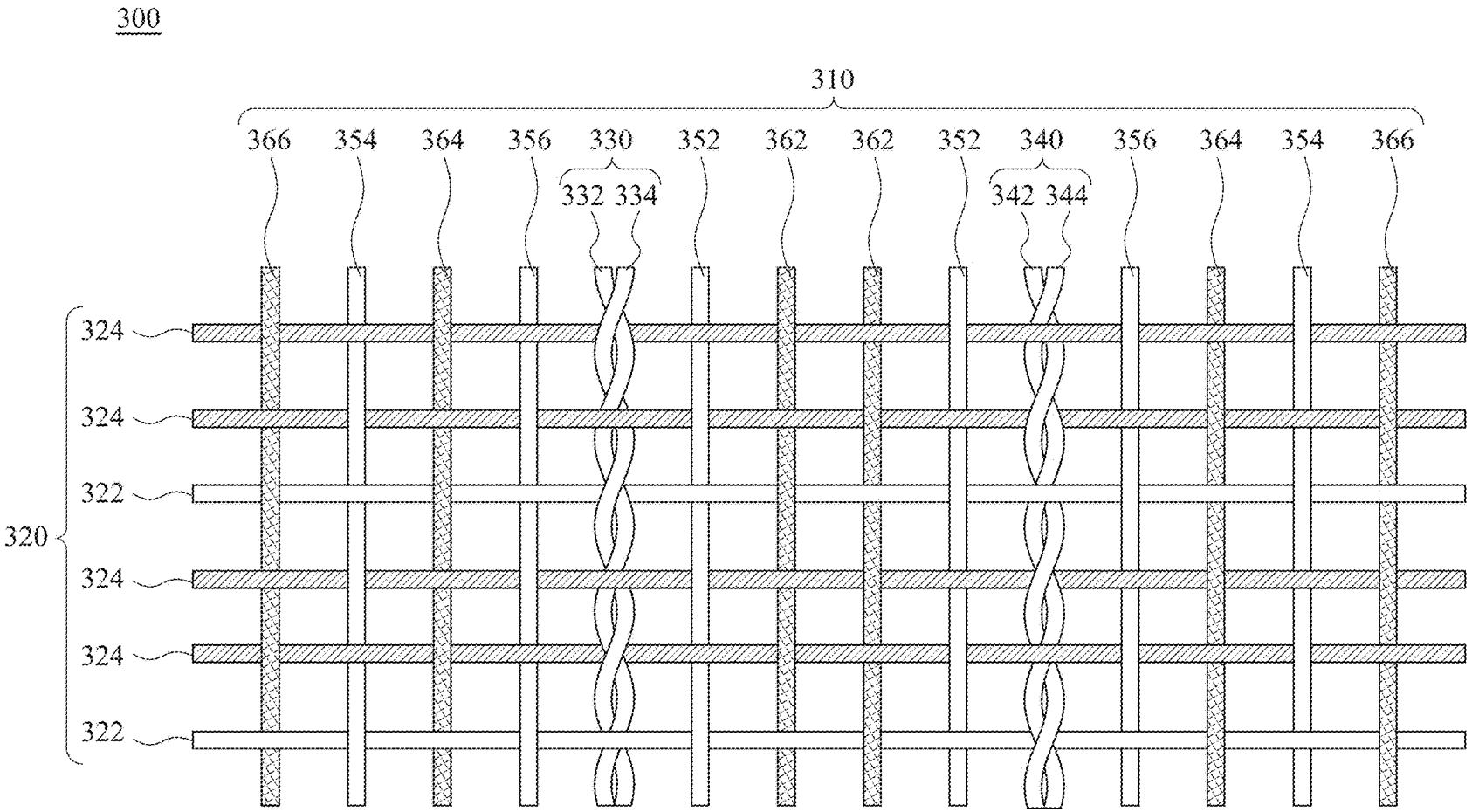
FIG. 4 is a schematic view illustrating the conductive textile according to an embodiment of the present disclosure.

Please refer to FIG. 4. FIG. 4 is a schematic view illustrating the conductive textile 300 according to the example 2 of the present disclosure. The conductive textile 300 includes warp 310 and weft 320, and the warp 310 and the weft 320 are interwoven to form the conductive textile 300.

The warp 310 includes a signal-transmitting unit 330, an electrical connecting unit 340, and a first warp conductive fiber 352, a second warp conductive fiber 354, a third warp conductive fiber 356, a first warp insulating fiber 362, a second warp insulating fiber 364 and a third warp insulating fiber 366. The signal-transmitting unit 330 consists of a first signal-transmitting cable 332 and a second signal-transmitting cable 334, which are intertwined. Each of the first signal-transmitting cable 332 and the second signal-transmitting cable 334 includes a central conductive fiber (not shown) and an outer insulating layer (not shown). The electrical connecting unit 340 consists of a first power cable 342 and a second power cable 344, which are intertwined. Each of the first power cable 342 and the second power cable 344 includes a central conductive fiber (not shown) and an outer insulating layer (not shown). The first warp conductive fiber 352 is disposed between the signal-transmitting unit 330 and the electrical connecting unit 340. The second warp conductive fiber 354 is disposed on the individual outside of the signal-transmitting unit 330 and the electrical connecting unit 340. The "outside" refers to the sides opposite to the sides of the signal-transmitting unit 330 and the electrical connecting unit 340 facing to each other. The third warp conductive fiber 356 is disposed on the individual outside of the signal-transmitting unit 330 and the electrical connecting unit 340, and directly adjacent to the signal-transmitting unit 330 or the electrical connecting unit 340. The first warp insulating fiber 362 is disposed between the first warp conductive fibers 352. The second warp insulating fiber 364 is disposed between the second warp conductive fiber 354 and the third warp conductive fiber 356. The third warp insulating fiber 366 is disposed on the outermost side of the warp 310. The "outermost" side refers to the two external sides of aligned-warp 310.

A weft 320 includes a weft conductive fiber 322 and a weft insulating fiber 324. The weft insulating fiber 324 is beaten up twice, and then the weft insulating fiber 324 and the conductive fiber are beaten up alternatively.

Example 3

Figure 5:
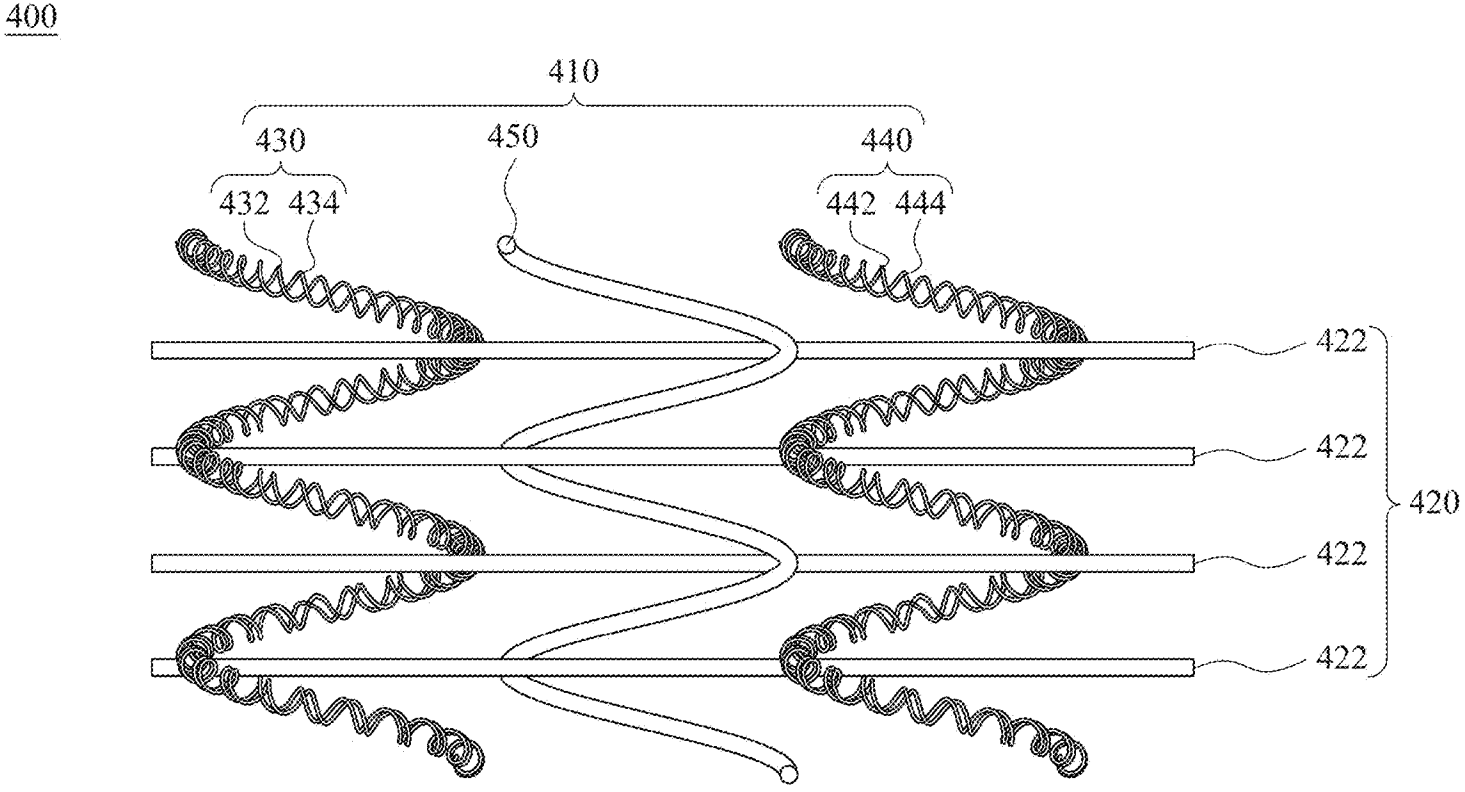
FIG. 5 is a schematic view illustrating the conductive textile according to an embodiment of the present disclosure.

Please refer to FIG. 5. FIG. 5 is a schematic view illustrating the conductive textile 400 according to the example 3 of the present disclosure. The conductive textile 400 includes warp 410 and weft 420, and the warp 410 and the weft 420 are interwoven to form the conductive textile 400.

The warp 410 includes a signal-transmitting unit 430, an electrical connecting unit 440 and a first warp conductive fiber 450. The signal-transmitting unit 430 consists of a first signal-transmitting cable 432 and a second signal-transmitting cable 434, which are intertwined. Each of the first signal-transmitting cable 432 and the second signal-transmitting cable 434 includes a central conductive fiber (not shown) and an outer insulating layer (not shown). The electrical connecting unit 440 consists of a first power cable 442 and a second power cable 444, which are intertwined. Each of the first power cable 442 and the second power cable 444 includes a central conductive fiber (not shown) and an outer insulating layer (not shown). The first warp conductive fiber 450 is disposed between the signal-transmitting unit 430 and the electrical connecting unit 440. The warp 410 of the conductive textile 400 presents an s-type trace. The first signal-transmitting cable 432, the second signal-transmitting cable 434, the first power cable 442, the second power cable 444 and the first warp insulating fiber 450 are one of the major materials of warp traversing. The warp materials are rubber band yarns or elastomeric yarns. The signal-transmitting cables or the power cables, which has less than or equal to 90 degrees after traversing, are intertwined with the warp 410 to form a wave pattern so as to provide the conductive textile having good elasticity and tensile strength. A Weft 420 includes a weft conductive fiber 422.

When the length of the conductive textile 400 is 8 cm, the coefficient of elasticity (which is the elongation of the conductive textile 400 after stretched or not) may large than 1.71.

To sum up, the warp conductive fiber is disposed between the signal-transmitting unit and the electrical-transmitting unit in the conductive textile of the present disclosure so as to offset signal attenuation during the signal bus transmission and obstruct the interference sources from lateral level. Simultaneously, the composite yarns (including the weft conductive fiber and the insulating fiber) are weft sandwiched in weaving to form a 3D stereoscopic shielding net, so that the conductive textile of the present disclosure may resist the noise. The present invention provides a flat conductive textile which can resist noise and combine with the clothes by sewing, and has high strength and flexibility by adjusting the wire arrangement of the textile, complex multi-signal conductive and shielding weaving organization structure. The conductive textile of the present disclosure enhances the additional values of yarns and has multiple applications, for example, it may be hidden in general fabric to function as signal transmission. For instance, the conductive textile of the present disclosure may be applied to the wearable application market or electrical appliances, etc. Examples in the wearable application market are electronic smart clothing, smart home, wearing apparel, electrical transmission ropes, etc. The conductive textile of the present disclosure may also be used in 3C accessories having electrical transmission. The conductive textile of the present disclosure may also be applied to the weaving of the signal of appliances.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A conductive textile, comprising:

warp, comprising:

a signal-transmitting unit consisting of a first signal-transmitting cable and a second signal-transmitting cable, which are intertwined, and each of the first signal-transmitting cable and the second signal-transmitting cable including a central conductive fiber and an outer insulating layer;

an electrical connecting unit consisting of a first power cable and a second power cable; and at least a first warp conductive fiber disposed between the signal-transmitting unit and the electrical connecting unit; and weft comprising:

a weft conductive fiber, and the warp and the weft interwoven.

2. The conductive textile of claim 1, wherein the amount of the first warp conductive fiber is 2.

3. The conductive textile of claim 1, wherein the materials of the central conductive fiber, the first warp conductive fiber and the weft conductive fiber are individually selected from silver, copper, carbon black, graphite, graphene, stainless steel, polyaniline or Polyethylenedioxythiophene (PEDOT: PSS).

4. The conductive textile of claim 1, wherein the materials of the outer insulating layer are selected from polyvinyl chloride (PVC), Polytetrafluoroethene (PTFE), Polyurethane (PU), polyacrylic acid or polyimide and the derivatives thereof.

5. The conductive textile of claim 1, wherein the warp further comprises at least a first warp insulating fiber disposed between the signal-transmitting unit and the electrical connecting unit.

6. The conductive textile of claim 5, wherein the first warp insulating fiber is arranged between at least two of the first warp conductive fibers.

7. The conductive textile of claim 1, wherein the individual outside of the signal-transmitting unit and the electrical connecting unit has at least a second warp conductive fiber disposed thereon, and at least a second warp insulating fiber is disposed between the second warp conductive fiber and the signal-transmitting unit or the electrical connecting unit.

8. The conductive textile of claim 1, wherein the individual outside of the signal-transmitting unit and the electrical connecting unit has at least a third warp conductive fiber disposed thereon, and the third warp conductive fiber is directly adjacent to the signal-transmitting unit or the electrical connecting unit.

9. The conductive textile of claim 1, wherein the warp further comprises at least two third warp insulating fibers disposed on the outermost side of the warp.

10. The conductive textile of claim 1, wherein the warp is an axially symmetric structure.

11. The conductive textile of claim 1, wherein the weft further comprises a weft insulating fiber.

12. The conductive textile of claim 11, wherein the weft insulating fiber is between the adjacent weft conductive fibers.

13. The conductive textile of claim 11, wherein the weft insulating fiber and the weft conductive fiber are intertwined.

14. The conductive textile of claim 1, wherein the warp presents an s-type trace.

15. The conductive textile of claim 1, wherein the twisting degrees of the signal-transmitting unit and the electrical connecting unit are equal to or large than 75 TPM.

* * * * *